United States Patent [19]

Ichikawa

[11] 4,416,594

[45] Nov. 22, 1983

[54] HORIZONTAL TYPE VIBRATING COMPRESSOR

[75] Inventor: Kaoru Ichikawa, Shiraoka, Japan

[73] Assignee: Sawafuji Electric Company, Ltd., Japan

[21] Appl. No.: 177,591

[22] Filed: Aug. 12, 1980

[30] Foreign Application Priority Data

Aug. 17, 1979 [JP] Japan ..... 54-113615[U]
Apr. 9, 1980 [JP] Japan ..... 55-48041[U]

[51] Int. Cl.[3] ..... F04B 21/00

[52] U.S. Cl. ..... 417/360; 417/372; 417/417; 248/606; 248/612; 248/621

[58] Field of Search ..... 417/363, 416, 360, 902, 417/417, 415, 423, 372, 365, 366; 248/638, 635, 621, 612, 606; 267/140, 4; 210/507

[56] References Cited

U.S. PATENT DOCUMENTS

| | | | |
|---|---|---|---|
| 2,179,268 | 11/1939 | Neeson | 417/419 |
| 2,741,425 | 4/1956 | Scheldorf | 417/902 |
| 2,885,142 | 5/1959 | Eberhart | 248/606 |
| 2,952,430 | 9/1960 | Garman | 248/606 |
| 3,215,343 | 11/1965 | Gannaway | 417/363 |
| 3,239,132 | 3/1966 | Frank et al. | 417/419 |
| 3,597,122 | 6/1971 | Farmer | 417/417 |
| 3,911,962 | 10/1975 | Chomat et al. | 138/DIG. 2 |
| 4,102,785 | 7/1978 | Head et al. | 210/507 |
| 4,184,810 | 1/1980 | Dyhr et al. | 417/363 |

FOREIGN PATENT DOCUMENTS

| | | | |
|---|---|---|---|
| 1597934 | 1/1934 | Australia | 248/15 |
| 2318747 | 4/1973 | Fed. Rep. of Germany | 417/363 |
| 44-29955 | 12/1969 | Japan | 417/363 |

*Primary Examiner*—William R. Cline
*Assistant Examiner*—John M. Kramer
*Attorney, Agent, or Firm*—McGlew and Tuttle

[57] ABSTRACT

A horizontal type vibrating compressor having a cylindrical container for accommodating a compressor proper which is disposed horizontally, and closure members for closing both open ends of the cylindrical container; and having such a construction that a piston fixed to a driving coil is caused to vibrate in substantially horizontal direction in a cylinder, wherein coil springs are respectively interposed in the compressed state between each closure member and the compressor proper; cushioning members are fixed via cup-shaped holders to any one side of the compressor proper or the closure members; pin-shaped supporting members, which are adapted to be axially slidable by engaging with the cylindrical portion of the cushioning members are fixed to the other side of the compressor proper or the closure members; and an air/oil intake tube connecting the outside and inside of the compressor proper is provided, the outer end thereof being connected to a fiber braided tube disposed on the lower inside part of the container, and the other end thereof being disposed above the portion where the piston enters the cylinder within the compressor proper.

2 Claims, 4 Drawing Figures

HORIZONTAL TYPE VIBRATING COMPRESSOR

BACKGROUND OF THE INVENTION

1. Field of the Invention

This invention relates generally to a horizontal type vibrating compressor, and more specifically to a horizontal type vibrating compressor comprising a cylindrical container for accommodating a compressor proper, which is disposed horizontally, and closure members for closing both open ends of the container wherein coil springs are respectively interposed in the compressed state between each closure member and the compressor proper; cushioning members and supporting members are provided to support the compressor proper within the container; and an air/oil intake tube connecting the outside and inside of the compressor proper is provided, the outer end thereof being connected to a fiber braided tube disposed on the lower inside part of the container, and the inner end thereof being disposed above the portion where a compressor piston enters a compressor cylinder within the compressor proper.

2. Description of the Prior Art

The conventional vibrating compressor heretofore developed and put into application is usually constructed, from considerations of construction and driving principle, as the vertical type which is designed to cause compression in the vertical direction. Consequently, small household refrigerators, refrigerators for use on board automobiles or boats and other various products using the vibrating compressors are largely of such a construction that the vertical type vibrating compressor can be incorporated. In recent years, however, the need for horizontal type vibrating compressors is increasingly felt from the viewpoint of providing flexibility in the type, size and construction of such products as well as the space for installing the vibrating compressor.

FIG. 1 is a longitudinal section of a horizontal type vibrating compressor designed to satisfy such a demand. In the figure, reference numeral 1 refers to a cylindrical container; 2 and 2' to mounting legs fixed to the lower part of the container 1; 3 and 3' to closure members; 4 to a suction tube; 5 to a discharge tube; 6 to a compressor proper; 7 and 7' to compressor-side supporting members; 8 and 8' to container-side supporting members; 9 and 9' to coil springs; 10 to an air/oil intake tube, respectively.

The compressor proper 6 is suspended by the coil springs 9 and 9' engaging with the compressor-side supporting members 7 and 7' and the container-side supporting members 8 and 8' within the cylindrical container 1, which is closed by the closure members 3 and 3'. The refrigerant gas introduced through the suction tube 4 is mixed with the lubricating oil, which is injected in small quantities on the bottom of the container 1, at a predetermined ratio and is sucked through the air/oil intake tube 10 into the compressor proper 6. The lubricating oil sucked into the compressor proper 6 lubricates the compressor piston and is discharged, together with the refrigerant gas, through the discharge tube 5 to the outside.

This type of horizontal type vibrating compressor is widely used in small-sized household refrigerators, refrigerators on board automobiles and boats because of small size, lightweight and low power consumption. When used on board a vehicle, however, large acceleration or deceleration during start and stop of the vehicle, or large vibration or impact exerted to the container 1 during travelling on rough roads may cause the compressor proper 6 to rock in various directions within the container 1 and to collide against the inner walls of the container 1 or the closure members 3 and 3', resulting in uncomfortable noises or damages to the compressor proper 6.

Needless to say, this type of compressor requires the refrigerant gas and the lubricating oil for lubricating moving contact surfaces such as piston to be mixed at a predetermined ratio, compressed and recirculated to ensure uniform refrigerating characteristics and to prevent the wear and seizure of moving contact surfaces such as piston.

In the horizontal type compressor as shown in FIG. 1, however, the bottom of the cylindrical container 1 housing the compressor proper 6 is oblong in the horizontal direction, so that the level of lubricating oil collecting on the bottom of the container greatly varies if the vehicle is tilted for some reason or other. This causes the amount of oil sucked into the air/oil intake tube 10 to change, leading to changes in the mixing ratio of the refrigerant and the lubricating oil, or the sucking-in of the refrigerant gas or the lubricating oil alone in extreme cases.

Furthermore, the lubricating oil tends to lubricate only the lower contact surface between the piston and the cylinder since the piston of the vibrating compressor vibrates in essentially horizontal direction, instead of revolving within the cylinder. This often causes seizure of the contact surface between the piston and the cylinder due to inadequate lubrication.

SUMMARY OF THE INVENTION

This invention is intended to overcome the aforementioned problems. It is a first object of this invention to provide a horizontal type vibrating compressor which prevents the vibrations generated by the horizontally disposed compressor proper from being transmitted to the outside. It is a second object of this invention to provide a horizontal type vibrating compressor of such a construction that, when mounted on a travelling object such as automobile, contact or collision of the compressor proper with the container due to sudden impact from the outside is prevented. It is a third object of this invention to provide a horizontal type vibrating compressor in which cushioning members for absorbing the aforementioned vibration or sudden impact are interposed between the supporting members. It is a fourth object of this invention to provide a horizontal type vibrating compressor of such a construction that an adequate amount of lubricating oil is fed to the contact surface between the piston and the cylinder by mixing the lubricating oil with the refrigerant gas circulating in the compressor proper, and the mixing ratio of the refrigerant gas and the lubricating oil is prevented from being suddenly changed.

These and other objects, features and advantages of this invention may be readily ascertained by referring to the following description and appended drawings.

DETAILED DESCRIPTION OF THE EMBODIMENT

Figure 1:
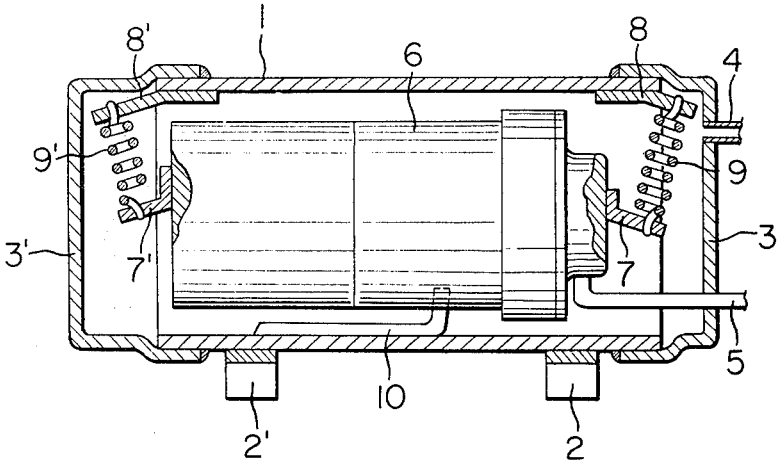
FIG. 1 PRIOR ART
FIG. 1 is a longitudinal section of a conventional horizontal type vibrating compressor.
Figure 2:
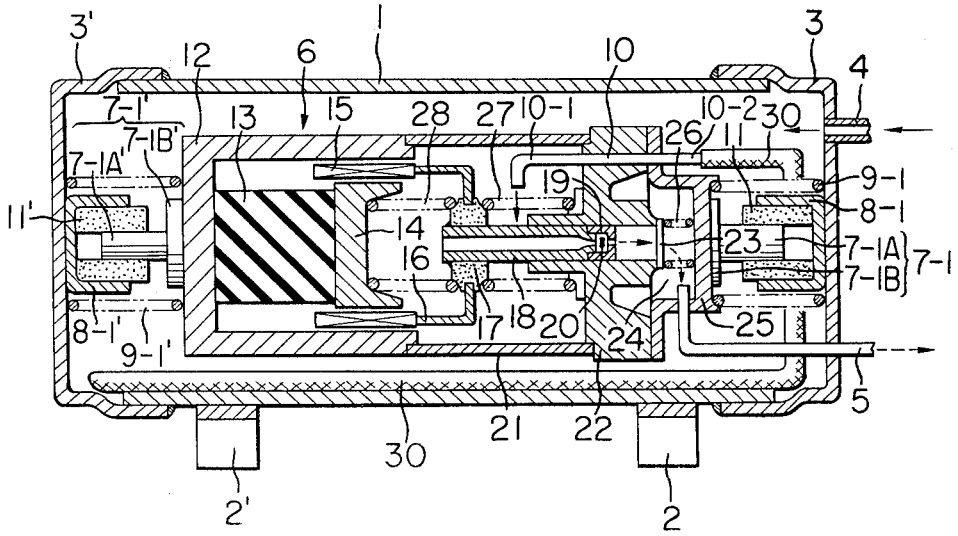
FIG. 2 is a longitudinal section of an embodiment of this invention.
Figure 3:
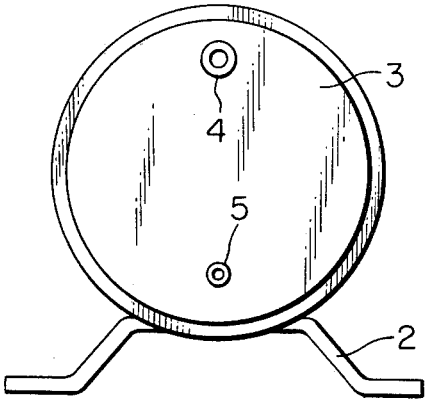
FIG. 3 is a righthand side view of the embodiment shown in FIG. 2.
Figure 4:
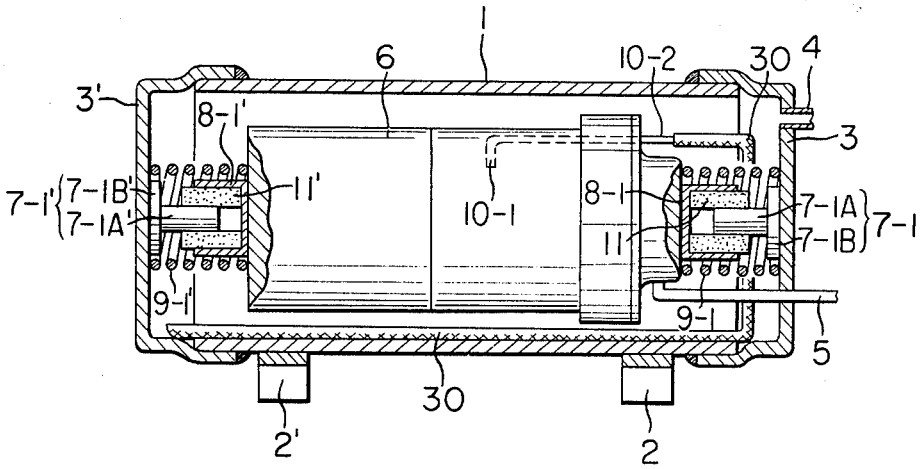
FIG. 4 is a longitudinal section of another embodiment of this invention.

In FIGS. 2 through 4, the same reference numerals as those of FIG. 1 refer to like parts throughout. Numerals 7-1 and 7-1' to pin-shaped supporting members formed by supporting members proper 7-1A and 7-1A' and seats 7-1B and 7-1B' into a T-shaped cross section; 8-1 and 8-1' to cup-shaped holders; 9-1 and 9-1' to coil springs; 10-1 to an opening of the air/oil intake tube extending into the compressor proper 6; and 10-2 to an outer end of the air/oil intake tube 10; 11 and 11' to cylindrical cushioning members, made of cushioning material such as synthetic resin, etc., fixedly inserted into the cups of the holders 8-1 and 8-1' to form cushioning members. The pin-shaped supporting members 7-1 and 7-1' are axially slidably fitted to the sleeve shaped cushioning members 11 and 11', and the coil springs 9-1 and 9-1' are interposed between the compressor proper 6 and the closure members 3 and 3' in the compressed state to horizontally support the compressor proper 6 in the axial direction. As shown in FIGS. 2 and 4, each cushioning member defines a cylindrical space for receiving each pin-shaped member.

The compressor proper 6 consists of a cup-shaped yoke 12; a magnet 13 fixed to the bottom of the yoke 12, a round tray-shaped magnetic pole 14 fixed to an end of the magnet 13; a driving coil 15 inserted in an annular gap defined by the magnetic pole 14 and the yoke 12; a cylindrical pumping piston 18, an end thereof being fixed to an end of the coil 15 via a frame 16 and a supporting block 17; a suction valve chamber 19 formed on the other end of the piston 18; a suction valve 20 provided in the suction valve chamber 19; a pumping cylinder 22 fixed to the open end of the yoke 12 via a distance case 21 for accommodating the piston 18; a discharge valve 23 provided on an end of the cylinder 22; a cover 25 covering the outer periphery of the discharge valve 23 to define a discharge valve chamber 24; a valve spring 26 interposed between the bottom of the cover 25 and the discharge valve 23; resonating coil springs 27 and 28 interposed respectively between the magnetic pole 14 and the supporting block 17 of the piston 18, and between the supporting block 17 and the cylinder 22; and an air/oil intake tube 10 connecting the inside and outside of the compressor proper 6. Numeral 30 refers to a braided tube, made of glass fiber, for example, which is disposed on the lower inside part of the container 1 and connected to the outer end 10-2 of the air/oil intake tube 10. The opening 10-1 of the air/oil intake tube 10 is bent downward and disposed above the portion where the piston 18 is inserted into the cylinder 22. The braided tube 30 is disposed on the lower inside part of the container 1, extending from one end to the other end of the container 1 in the axial direction.

In the horizontal type vibrating compressor embodying this invention having the aforementioned construction, when an alternating voltage is applied to the driving coil 15 to feed an alternating current, the driving coil 15 vibrates in right and left directions in accordance with the frequency of the alternating current within an annular gap in which a closed magnetic path is formed by the magnet 13, the yoke 12 and the magnetic pole 14. This vibration is amplified by the resonating effect of the coil springs 27 and 28 to cause the piston 18 connected to the driving coil 15 to reciprocate within the cylinder 22.

The refrigerant gas and the lubricating oil introduced by the reciprocating motion of the piston 18 into the container 1 through the suction tube 4, as shown by the solid line arrows in FIG. 2, are fed at a predetermined mixing ratio to the compressor proper 6 through the fiber braided tube 30 and the air/oil intake tube 10. Then, the refrigerant gas and the lubricating oil are compressed and discharged to the discharge valve chamber 24, as shown by the dotted line arrows in the figure, by the pumping action of the suction valve 20 of the piston 18 and the discharge valve 23 of the cylinder 22, and fed to an evaporator (not shown) of the refrigerating system, for example, through the discharge tube 5.

FIG. 4 illustrates another embodiment of this invention. The construction of the embodiment shown in FIG. 4 is essentially the same as that shown in FIGS. 2 and 3 except that the cup-shaped supporting members 8-1 and 8-1' are fixed to the compressor proper 6 and the pin-shaped supporting members 7-1 and 7-1' to the closure members 3 and 3'. Therefore, specific description of the operation of the embodiment, which is essentially the same as that shown in FIGS. 2 and 3, has been omitted here.

The horizontal type vibrating compressor embodying this invention having the aforementioned construction can effectively dampen transmission of the vibrations of the compressor proper 6 during operation to the outside of the container 1 since the vibrations are absorbed by the coil springs 9-1 and 9-1' and the cylindrical cushioning members 11 and 11'. Furthermore, even when the horizontal type vibrating compressor is incorporated in a car refrigerator, for example, and is subjected to large acceleration/deceleration during the start and stop of the automobile or large external impact during travelling on a rough road, collision of the compressor proper 6 against the inside walls of the container 1 or the closure members 3 and 3' can be perfectly eliminated because the compressor proper 6 moves only in the axial direction of the pin-shaped supporting members 7-1 and 7-1'. Excessive axial movement of the compressor proper 6 would cause the cushioning materials 11 and 11' and the seats 7-1B and 7-1B' of the pin-shaped supporting members 7-1 and 7-1' to collide with each other. In such a case, however, no noises are generated due to the elasticity of the cushioning members 11 and 11'.

As the outer end 10-2 of the air/oil intake tube 10 connecting the outside and inside of the compressor proper 6 is connected to the fiber braided tube 30 disposed on the lower part of the container 1, as described above, constant flow of the refrigerant gas and the lubricating oil through the interstices of the entire fiber braided tube 30 can be ensured even when a vehicle or boat equipped on board with the compressor is tilted during travelling, causing the level of lubricating oil collected on the lower part of the container 1 to change. That is, even when the level of lubricating oil collected on the lower part of the container 1 changes, the mixing ratio of the refrigerant gas, which is compressed and recirculated, and the lubricating oil can be maintained substantially constant at all times because the gas/oil intake 10 takes up the refrigerant gas and the lubricating oil through the fiber braided tube 30 which is always at least partly in the oil.

Furthermore, as the opening 10-1 of the air/oil intake tube 10 is disposed above the portion where the piston 18 is inserted into the cylinder 22, the lubricating oil is sprayed from above the piston 18, eliminating the seizure of the upper contact surface of the piston 18 and the cylinder 22 due to insufficient lubrication, as heretofore experienced.

What is claimed is:

1. In a horizontal type vibrating compressor having a cylindrical container defining a chamber and having a horizontally extending axis for accommodating a compressor unit having a horizontally extending axis, the container having a pair of closure members closing opposite axial ends of the container, each closure member spaced outwardly of opposite axial ends of the compressor unit, the container adapted to receive a lubricant therein adjacent the bottom of the chamber, the compressor unit defining a compressor chamber and including a horizontally extending pumping cylinder and a horizontally extending and movable pumping piston inserted into the pumping cylinder at a location of the compressor chamber, the compressor unit including a magnet and a coil adapted to be energized for vibrating movement with respect to the magnet to move the pumping piston horizontally, an improvement comprising:

a sleeve-shaped cushioning member defining a cylindrical space and made of cushioning material connected to one of an inner surface of one closure member and a spacing opposite axial end of the compressor unit, said cushioning member disposed coaxially with the compressor unit axis;

a pin-shaped supporting member connected to the other of the closure member inner surface and facing opposite axial end of the compressor unit, said pin-shaped supporting member extending coaxially with the compressor unit axis and received for horizontal movement in said cylindrical space of said cushioning member;

a pre-compressed spring engaged between the closure member inner surface and the facing opposite axial end of the compressor unit whereby relative axial movement between the compressor unit and the container are restricted by a biasing force of said precompressed spring and an engagement between said pin-shaped supporting member and said cushioning member; and an air-oil mixture supplying conduit connected between a bottom of said container chamber and a top of said compressor chamber, said conduit made at least in part of braided fibers in said container chamber for admitting an air/mixture into said conduit through said braided fibers and having an end disposed above the portion of the compressor chamber where the pumping piston is inserted into the pumping cylinder.

2. An improvement according to claim 1, including a cup-shaped member connected to said one of the closure member inner surface and facing opposite axial end of the compressor unit for receiving said cushioning member, and a seat connected to said other of the closure member inner surface and facing opposite axial end of the compressor unit for carrying said pin-shaped supporting member, said cushioning member having a radially extending face and said seat extending radially for receiving said radially extending face of said cushioning member.

* * * * *